US009389035B2

(12) United States Patent
Parsadayan

(10) Patent No.: US 9,389,035 B2
(45) Date of Patent: Jul. 12, 2016

(54) RETROFIT FOR FIREARM HAVING GAS-OPERATED RELOADING SYSTEM

(71) Applicant: Walter Parsadayan, Laguna Niguel, CA (US)

(72) Inventor: Walter Parsadayan, Laguna Niguel, CA (US)

( * ) Notice: Subject to any disclaimer, the term of this patent is extended or adjusted under 35 U.S.C. 154(b) by 72 days.

(21) Appl. No.: 14/503,771

(22) Filed: Oct. 1, 2014

(65) Prior Publication Data

US 2015/0090109 A1 Apr. 2, 2015

Related U.S. Application Data

(60) Provisional application No. 61/885,420, filed on Oct. 1, 2013.

(51) Int. Cl.
*F41A 5/00* (2006.01)
*F41A 5/26* (2006.01)

(52) U.S. Cl.
CPC ..... *F41A 5/26* (2013.01)

(58) Field of Classification Search
CPC ..... F41A 5/18; F41A 5/26; F41A 9/38; F41A 3/12; F41A 3/62; F41A 3/72; F41A 5/22; F41A 17/00; F41A 17/30; F41A 19/43; F41A 21/28; F41A 5/30; F41A 11/723; F41A 19/03; F41B 11/723; F41B 11/55; F41B 11/60; F41B 11/72; F41B 11/64; F41B 11/721; F41B 11/00; F41B 11/724
USPC ..... 89/191.01, 128, 193
See application file for complete search history.

(56) References Cited

U.S. PATENT DOCUMENTS

| | | | | |
|---|---|---|---|---|
| 3,736,839 | A * | 6/1973 | Childers | 89/128 |
| 4,703,826 | A * | 11/1987 | Byron | 89/188 |
| 5,179,245 | A * | 1/1993 | Straka | 89/1.4 |
| 7,856,917 | B2 * | 12/2010 | Noveske | 89/193 |
| 2012/0204712 | A1 * | 8/2012 | Hauck | 89/128 |
| 2013/0055883 | A1 * | 3/2013 | Cassels | 89/193 |
| 2013/0098235 | A1 | 4/2013 | Reinken | |
| 2014/0090550 | A1 * | 4/2014 | Wilcox et al. | 89/193 |

* cited by examiner

*Primary Examiner* — Troy Chambers
*Assistant Examiner* — Bridget Cochran
(74) *Attorney, Agent, or Firm* — Fish & Tsang, LLP

(57) ABSTRACT

A retrofit apparatus is disclosed for a gas-operated reloading firearm having a pressure control unit to operate the firearm in either manual or semi-automatic operation. The pressure control unit is coupled to the reloading unit to reduce a gas flow to the reloading unit in a first configuration and allow the gas flow to the reloading unit in a second configuration. A controller is coupled to the pressure control unit to operate the firearm in the first or second configuration. The firearm operates in a first configuration requiring manual operation until it receives continuous manual actuation to enable the reloading unit in a second configuration.

15 Claims, 4 Drawing Sheets

RETROFIT FOR FIREARM HAVING GAS-OPERATED RELOADING SYSTEM

This application claims priority to U.S. Provisional Application Ser. No. 61/885,420, filed Oct. 1, 2013. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is a retrofit for a firearm having a gas-operated reloading system, and more specifically, a retrofit for modifying the firearm to disable the gas-operated reloading system in a default configuration and requiring continuous manual interaction to enable the gas-operated reloading system.

BACKGROUND

The following description includes information that may be useful in understanding the present invention. It is not an admission that any of the information provided herein is prior art or relevant to the presently claimed invention, or that any publication specifically or implicitly referenced is prior art.

Gas-operated reloading systems allow semi-automatic firearms to use the energy produced when firing a cartridge to eject a spent case and load a new cartridge. One benefit of the gas-operated reloading system is that users save time and effort by not having to manually open the barrel and insert a new cartridge. However, problems can arise in gas-operated reloading systems due to safety concerns and/or pressure changes in the reloading system caused by various environmental factors (e.g., adding silencer, changing caliber, temperature, etc.).

Some have contemplated retrofitting a firearm to address various needs. For example, U.S. Pat. No. 5,179,245 to Straka discloses a rifle adapter apparatus that permits conversion of a semi-automatic rifle to manual operation whereby an actuator rod is coupled to a rifle bolt handle. A user reciprocates the actuator rod handle to create a reciprocation of the rifle bolt and operate the semi-automatic rifle in manual operation. While this adapter apparatus appears to allow users to operate in manual operation, it may be burdensome for users to reciprocate the actuator rod to use manual operation.

Another example of a firearm retrofit is disclosed in U.S. Pat. Pub. 2013/0098235 to Reinken, which discloses an adjustable gas block designed to interfere with a gas-operated reloading system. The gas block uses a click adjustment valve screw to control the amount of gas that is allowed to pass into the gas-operated reloading system of the firearm. A spring mechanism holds the click adjustment screw when adjusted to any position. While it appears convenient to have a spring mechanism maintain a selected the amount of gas into the reloading system, this may be problematic for users that desire a higher requirement to transition between manual and semi-automatic operation for safety reasons.

Thus, there is still a need for a retrofit system for firearms having gas-operated reloading systems that effectively address safety and environmental issues.

SUMMARY OF THE INVENTION

The inventive subject matter provides apparatus, systems and methods in which a firearm having a gas-operated reloading unit is retrofitted to have manual operation (i.e., manual reloading) as a default configuration and semi-automatic operation (i.e., gas-operated reloading) when continuous manual actuation is received. It is contemplated that continuous manual actuation requires that a user hold a button, touchpad, or other suitable receiver with one hand while pulling the trigger of a firearm with the other hand. The gas-operated reloading unit is configured to use a gas flow produced by firing a cartridge to reload the firearm.

In one embodiment, a retrofit apparatus for a firearm comprises a pressure control unit coupled to the gas-operated reloading system. As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The pressure control unit has a first configuration that reduces the gas flow to the reloading unit in an amount effective to prevent the reloading unit from reloading the firearm. The pressure control unit has a second configuration that allows the gas flow to the reloading unit in an amount effective to enable the reloading unit to reload the firearm. A controller is operatively coupled to the pressure control unit to operate the firearm in the first or second configuration. The controller is configured to operate the firearm in the first configuration without continuous manual actuation, and operate the firearm in the second configuration with continuous manual actuation. In contemplated embodiments, the retrofit apparatus operates exclusively in either the first or second configuration. In other words, there are no stages or steps (i.e., intermediate configurations) in between the first and second configuration, but only a first and second configuration.

In some embodiments, the pressure control unit can include a ball valve that is sized and dimensioned to block the gas flow to the reloading unit in the first configuration, and to allow the gas flow to the reloading unit in the second configuration. In other embodiments, the pressure control unit can include a chamber that is sized and dimensioned to receive a portion of the gas flow when the pressure control unit is in the first configuration. It should be appreciated that by receiving a portion of the gas flow in the first configuration, the chamber reduces the pressure to the reloading unit in an amount effective to prevent the reloading unit from reloading the firearm. The pressure control unit can also include a vent sized and dimensioned to release a portion of the gas flow to the atmosphere when the pressure control unit is in the first configuration.

The position of the chamber is preferably upstream of the reloading unit. The chamber can be configured to send the portion of the gas flow to the reloading unit when the pressure control unit in the second configuration. Moreover, it is contemplated that chamber can have a vent configured to release the portion of the gas flow to the atmosphere when the chamber reaches 90% capacity. In other embodiments, the vent can be configured to release the portion of the gas flow to the atmosphere when the pressure control unit is in the first configuration.

The retrofit apparatus can also include a button that is operatively coupled to the controller, wherein the button is sized and dimensioned to receive continuous manual actuation. The button can have various suitable locations on the firearm, including the barrel, the handguard, and the pistol grip of the firearm. Therefore, a user can activate semi-automatic operation (i.e., enable the gas-operated reloading system) of the firearm by holding the button while pulling on the trigger. Once the user releases the button, the firearm returns to its default configuration of manual operation whereby the gas-operated reloading system is disabled. To re-enable the gas-operated reloading system, the user is required to hold the button while pulling the trigger of the firearm.

In preferred embodiments, the button is located so that one hand or finger is required to push the button while the other hand or finger is used for pulling the trigger of the firearm. The button is typically sized and dimensioned to receive a force from a finger of a user as the continuous manual actuation, which could be approximately 1 to 10 Newton. Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary. Thus, a user can toggle between semi-automatic and manual operation of the firearm.

The retrofit apparatus can also include a touchpad operatively coupled to the controller, wherein the touchpad is sized and dimensioned to receive continuous manual actuation. The touchpad can have various suitable locations on the firearm, including the barrel, the handguard, and the pistol grip of the firearm. The touchpad is typically sized and dimensioned to receive a force from a finger of a user as the continuous manual actuation. Similar to the button embodiment described above, a user is preferably required to contact the touchpad while pulling the trigger of the firearm to enable semi-automatic operation of the firearm, and loss of contact with the touchpad disables the gas-operated reloading system to require manual operation of the firearm. Thus, in such embodiment, it should be appreciated that contact of the touchpad can be received as the continuous manual actuation.

In another aspect, an improvement is contemplated for a gas-operated reloading firearm having a gas conduit coupled to a barrel of the rifle, wherein the gas conduit is sized and dimensioned to receive a portion of a gas flow produced by firing a cartridge, wherein the gas conduit further comprises a piston within the conduit, and wherein the piston is configured to (i) receive a force from the gas flow and (ii) transfer the force to a bolt carrier of the firearm to thereby reload the firearm. The improvement comprises a pressure control unit coupled to the conduit, such that the pressure control unit has a default configuration that reduces the force received by the piston so that the force transferred to the bolt is insufficient to reload the firearm.

It is further contemplated that a manually operable controller can be operatively coupled to the pressure control unit. In such embodiment, the manually operable controller can, upon continuous manual actuation, override the default configuration to a second configuration such that the force received by the piston and transferred to the bolt is sufficient to reload the firearm. As discussed above, the manually operable controller and the pressure control unit can be configured to exclusively switch between the default configuration and the second configuration. In other words, there are not steps or stages in between the default and second configuration, but rather only a default and a second configuration. In switching between the default and second configuration, it is contemplated that the manually operable controller is configured to require manual force of between 1 Newton and 10 Newton as the continuous manual actuation.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventor has discovered a retrofit apparatus for a firearm having a reloading unit that is configured to use a gas flow produced by firing a cartridge to reload the firearm. It is contemplated that long-stroke piston systems, short-stroke piston systems, and direct impingement systems can be retrofitted as described herein. Moreover, it should be noted that suitable firearms include gas-operated reloading pistols, rifles and shotguns.

The retrofit apparatus comprises a pressure control unit that is coupled to the gas-operated reloading system. The pressure control unit has (a) a first configuration that reduces the gas flow to the reloading unit in an amount effective to prevent the reloading unit from reloading the firearm, and (b) a second configuration that allows the gas flow to the reloading unit in an amount effective to enable the reloading unit to reload the firearm.

The first and second configuration can be toggled using a controller operatively coupled to the pressure control unit. The controller is configured to operate the firearm in the first configuration without continuous manual actuation, and operate the firearm in the second configuration with continuous manual actuation. Therefore, the firearm with the retrofit apparatus has a default, first configuration of manual operation (i.e., gas-operated reloading system is disabled) and a second configuration of semi-automatic operation (i.e., gas-operated reloading is enabled).

Figure 1:
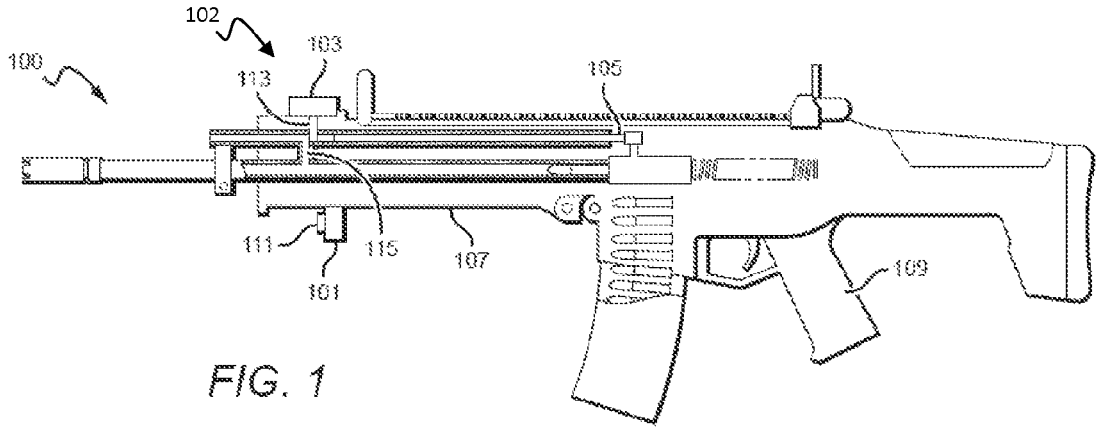
FIG. 1 is a side perspective view of an embodiment of a firearm having a retrofit apparatus in a first configuration.

FIG. 1 shows an embodiment of a firearm 100 having a retrofit apparatus 102. Firearm 100 has a gas-operated reloading unit 105 that is configured to use a gas flow produced by firing a cartridge to reload the firearm (see FIG. 4). Retrofit apparatus 102 comprises a pressure control unit 103. Pressure control unit 103 has a first configuration that reduces the gas flow to the reloading unit in an amount effective to prevent reloading unit 105 from reloading the firearm, and a second configuration that allows the gas flow to reloading unit 105 in an amount effective to enable reloading unit 105 to reload the firearm (i.e., semi-automatic operation). The retrofit apparatus 102 further includes a controller 101 operatively coupled to pressure control unit 103. Controller 101 is configured to operate firearm 100 in the first configuration without continuous manual actuation or the second configuration with continuous manual actuation.

Pressure control unit 103 can comprise a ball valve or any other restriction suitable unit that can restrict gas flow. The ball valve or any other suitable restriction unit is preferably sized and dimensioned to restrict the gas flow to reloading unit 105 in the first configuration, and to allow the gas flow to reloading unit 105 in the second configuration. Pressure control unit 103 can comprise a blocking member 113 located upstream of reloading unit 105. In the first configuration, pressure control unit 103 and blocking member 113 restrict gas flow to reloading unit 105 as shown in FIG. 1.

Controller 101 can be located on handguard 107 of firearm 100. In this embodiment, a user can either hold handguard 107 or simply hold controller 101 with one hand and use the other hand to pull the trigger when operating firearm 100. It should be appreciated that controller 101 could have other suitable locations on firearm 100, such as pistol grip 109 so that the user could access controller 101 using a thumb or other non-trigger finger (i.e., any finger besides the index finger). Furthermore, controller 101 could be a separate unit from firearm 100.

It is contemplated that controller 101 can communicate with pressure control unit 103 through actuators that link controller 101 and pressure control unit 103 to operate pressure control unit 103 in either the first or second configuration. Controller 101 can also communicate with pressure control unit 103 wirelessly via Bluetooth, wireless network, infrared or RFID to toggle pressure control unit between the first and second configuration. In further embodiments, controller 101 can further comprise a sensor, wherein the sensor can sense a manual actuation (e.g., pressure, light, touch) whereby controller 101 transitions pressure control unit 103 to the second configuration.

Controller 101 comprises a button 111 operatively coupled to the controller 101. Button 111 is sized and dimensioned to receive continuous manual actuation. While button 111 is shown as being on controller 101, it is contemplated that button is located on the barrel, handguard 107 or pistol grip 109 of the firearm 100.

Figure 2:
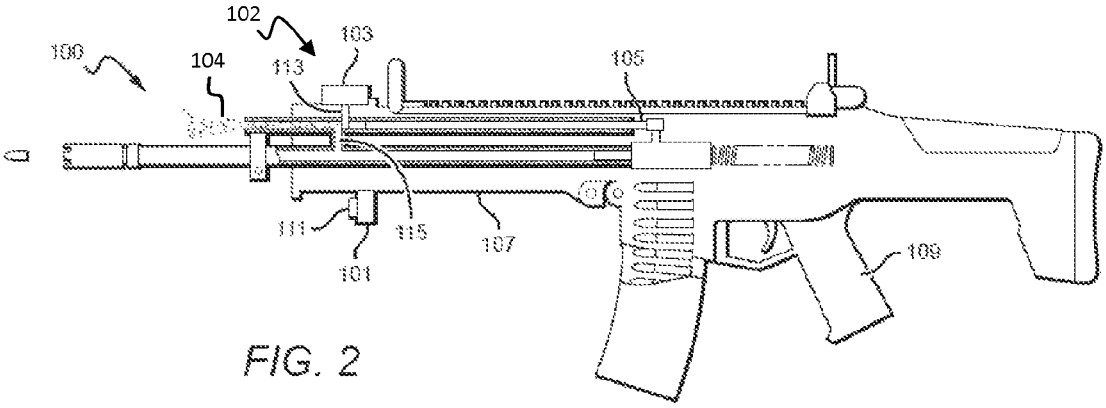
FIG. 2 is a side perspective view of the embodiment in FIG. 1 in a first configuration when a cartridge is fired.

It should be appreciated that a user can toggle firearm 100 between the first and second configuration using button 111. In one example, a user can hold pistol grip 109 with one hand and hold handguard 107 or controller 101 with the other hand. If user fails to hold button 111 when firing a cartridge, then controller 101 operates firearm 100 in the first configuration (i.e., pressure control unit 103 is in the first configuration blocking gas flow to reloading unit 105) as shown in FIG. 2. A gas flow 104 produced by the firing of the cartridge is prevented from flowing to reloading unit 105.

Without flow to reloading unit 105, firearm 100 functions as manual operation (e.g., bolt-action) requiring the user to manually reload firearm 100 (e.g., cycling the firearm by pulling on the bolt by hand). Thus, it should be appreciated that preferred embodiments of retrofit apparatus 102 operate firearm 100 in manual operation by default. In other words, the installation of retrofit apparatus 102 on firearm 100 automatically disables reloading unit 105 and further user interaction (e.g., continuous manual actuation) is needed to enable reloading unit 105.

Figure 3:
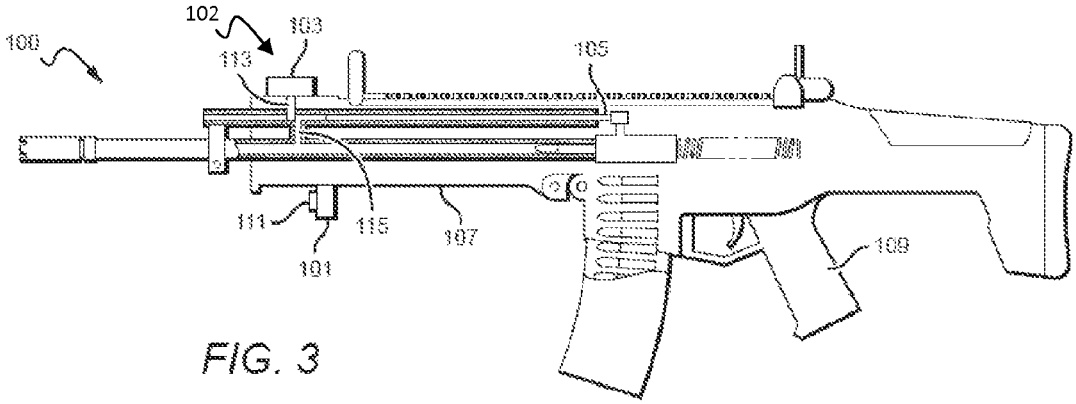
FIG. 3 is a side perspective view of the embodiment in FIG. 1 in a second configuration.
Figure 4:
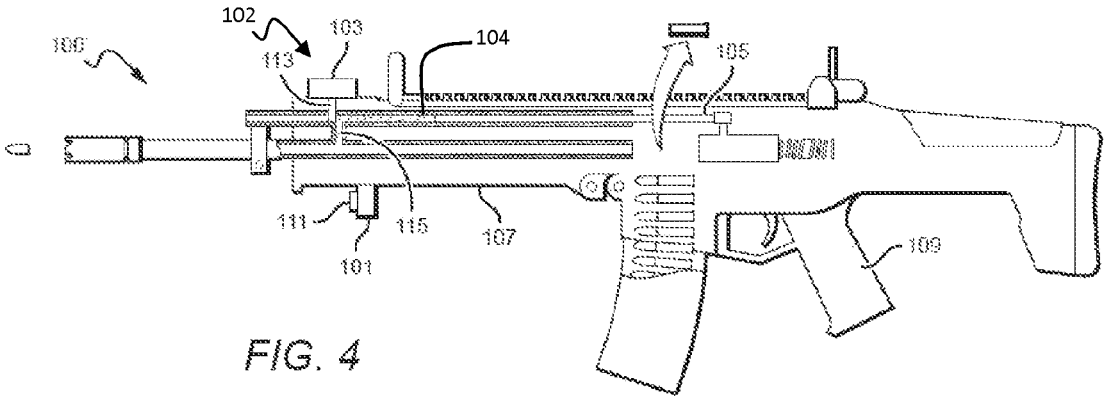
FIG. 4 is a side perspective view of the embodiment in FIG. 1 in a second configuration when a cartridge is fired.

FIG. 3 shows firearm 100 having pressure control unit 103 in a second configuration. As described above, controller 101 operates firearm 100 in the second configuration with continuous manual actuation. In one example, a user can hold pistol grip 109 with one hand and hold handguard 107 or controller 101. If user holds button 111 while pulling the trigger, controller 101 operates the firearm in the second configuration (i.e., the pressure control unit 103 is in the second configuration allowing gas flow to reloading unit 105) as shown in FIG. 4. Gas flow 104 produced by firing of the cartridge flows to gas reloading unit 105 to reload firearm 100. It should be appreciated that reloading firearm comprises extracting the spent cartridge and loading a new cartridge.

In contemplated embodiments, button 111 can be sized and dimensioned to receive a force from a finger of a user as the continuous manual actuation, which can be 1 to 10 Newton. The force required to push button 111 can also be increased to prevent young users from enabling reloading unit 105.

Figure 5:
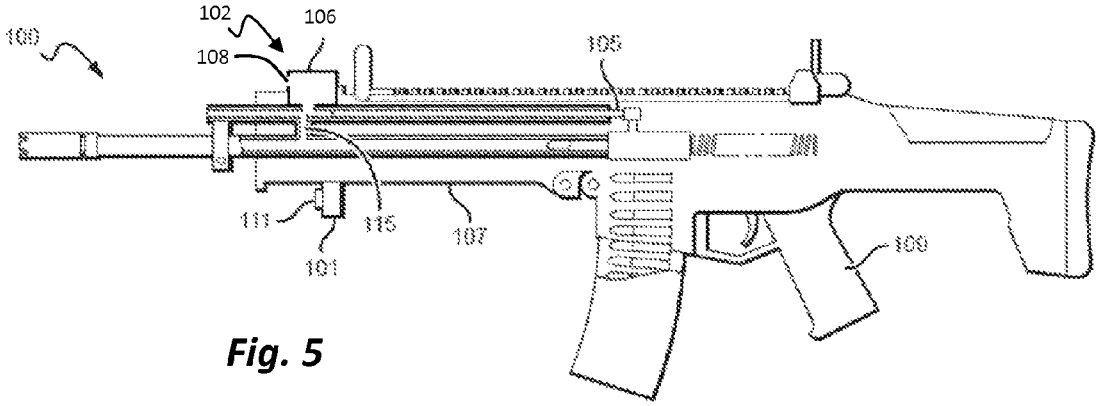
FIG. 5 is a side perspective view of an embodiment of a firearm having a retrofit apparatus including a chamber.

FIG. 5 shows that pressure control unit can include a chamber 106 that is sized and dimensioned to receive a portion of the gas flow when the pressure control unit is in the first configuration. Chamber 106 is preferably located upstream of reloading unit 105. It is contemplated that chamber 106 can be within pressure control unit or can be a separate unit that is coupled to pressure control unit.

It should be appreciated that chamber 106 can receive gas flow in an amount sufficient to disable reloading unit 105 to operate firearm 100 in manual operation in a first configuration. Once collected, chamber 106 can send the portion of gas flow collected to reloading unit 105 when pressure control unit is in the second configuration to assist in reloading firearm 100. Thus, some of the collected gas can be utilized to reload firearm 100 at a later point in time.

In addition, chamber 106 can comprise a vent 108 sized and dimensioned to release the portion of the gas flow collected by the chamber to the atmosphere when the chamber reaches 90% capacity or when the pressure control unit is in the first configuration. Chamber 106 can also include a valve or other suitable flow restriction device where gas flow is prevented from entering chamber 106 when pressure control unit is in the second configuration.

Figure 6:
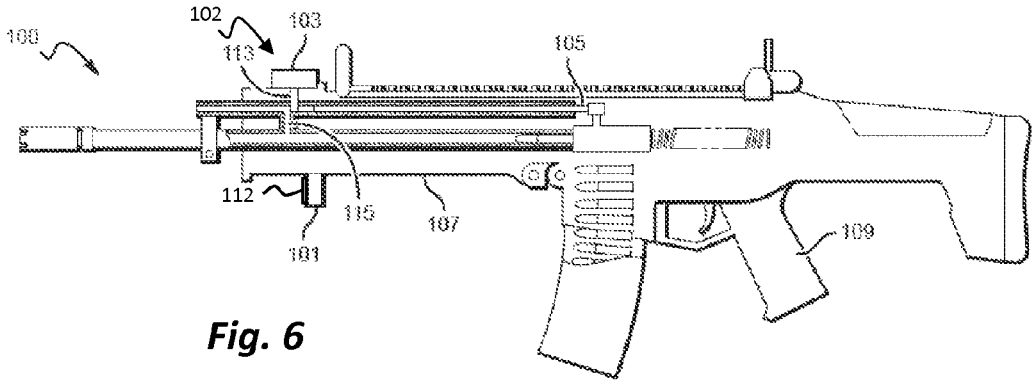
FIG. 6 is a side perspective view of an embodiment of a firearm having a retrofit apparatus including a touchpad.

As described above, controller 101 can comprise button 111. However, in other embodiments, controller can comprise of a touchpad 112 operatively coupled to controller 101 as shown in FIG. 6. Touchpad 112 is sized and dimensioned to receive continuous manual actuation. While touchpad 112 is shown to be on controller 101, it is contemplated that touchpad 112 can be located on the barrel, handguard 107 or pistol grip 109 of firearm 100. Touchpad 112 can also include fingerprint recognition as an additional safety measure.

Much like the button described above, touchpad 112 is sized and dimensioned to receive a force from a finger of a user as the continuous manual actuation. In one example, a user can hold firearm 100 by using one hand to hold pistol grip 109 and using the other hand to hold handrail 107 or controller 101. If the user pulls the trigger without holding or making contact with touchpad 112, controller 101 operates firearm 100 in manual operation (i.e., pressure control unit 103 is in a first configuration blocking gas flow to reloading unit 105). However, if the user pulls the trigger while holding or making contact with touchpad 112, controller 101 operates firearm in semi-automatic operation (i.e., pressure control unit is in the second configuration to allow gas flow to reloading unit 105).

It should be appreciated that the semi-automatic operation can be maintained over a cycle of shots by holding or making contact with touchpad 112.

While it is contemplated that controller 101 can operate firearm 100 in a variety of configurations to restrict gas flow to reloading unit 105, it is preferred that controller 101 operates firearm 100 only in the first configuration or the second configuration. Therefore, typical embodiments will not include stages or intermediate configurations between the first and second configurations.

Figure 7:
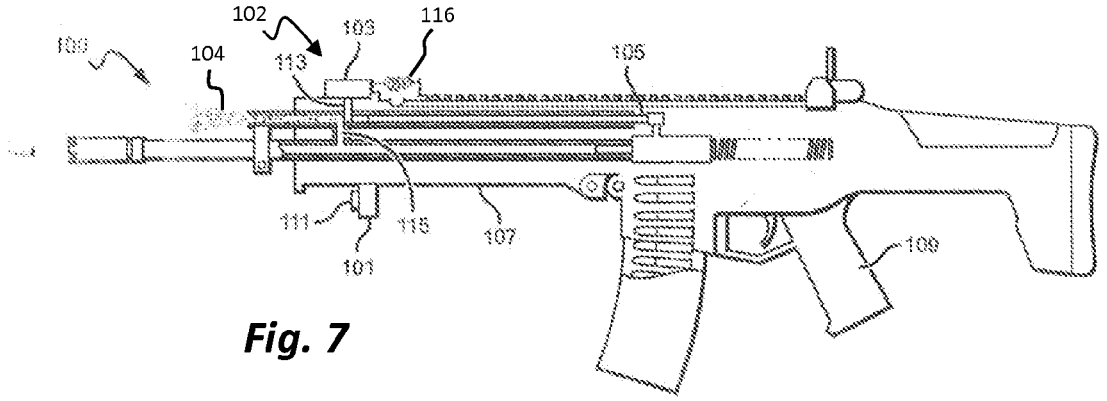
FIG. 7 is a side perspective view of a firearm having a retrofit apparatus including a spring in a first configuration when a cartridge is fired.
Figure 8:
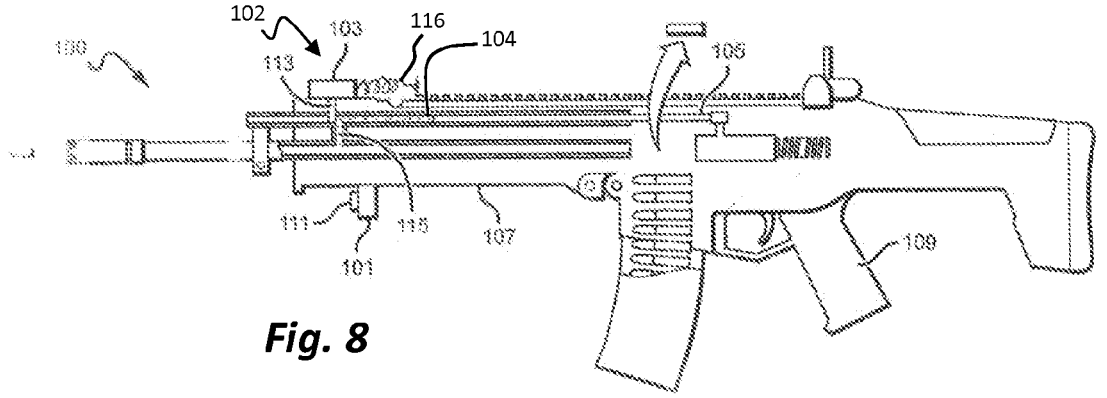
FIG. 8 is a side perspective view of a firearm having a retrofit apparatus including a spring in a second configuration when a cartridge is fired.

FIGS. 7 and 8 show firearm 100 having a pressure control unit 103 with a spring 116. Pressure control unit 103 is in the first configuration in FIG. 7 and the second configuration in FIG. 8. As shown, spring 116 can provide a force to shift pressure control unit 103 from the first configuration to the second configuration. In contemplated embodiments, pressure control unit 103 can be manually actuated to toggle between first and second configuration. In other contemplated embodiments, pressure control unit 103 can be toggled by controller 101 depending on whether there is continuous manual actuation.

While some of the embodiments show pressure control unit 103 shifting from one position to another depending on whether it is in the first or second configuration, it is contemplated that pressure control unit 103 can be stationary. A stationary pressure control unit 103 can simply be a valve or other suitable flow restriction device located upstream of reloading unit 105 as shown in FIG. 7 or in junction 115.

In another aspect, an improvement has been discovered in gas-operated reloading firearms. The gas-operated reloading firearm has a gas conduit coupled to a barrel of the firearm, such that the gas conduit is sized and dimensioned to receive a portion of a gas flow produced by firing a cartridge. The gas conduit further comprises a piston within the conduit, wherein the piston is configured to receive a force from the gas flow, and transfer the force to a bolt carrier of the firearm to thereby reload the firearm. The improvement of gas-operated reloading firearms includes a pressure control unit coupled to the conduit having a default configuration to reduce the force received by the piston. Therefore, the force transferred to the bolt is insufficient to reload the firearm.

The reloading firearm can also include a manually operable controller coupled to the pressure control unit. The controller is configured to, upon continuous manual actuation, override the default configuration to a second configuration such that the force received by the piston and transferred to the bolt is sufficient to reload the firearm. This can be accomplished by manually pulling, squeezing, turning, pushing the manually operable controller as the continuous manual actuation. In some embodiments, the manually operable controller can be a button or a touchpad. It is contemplated that the manually operable controller is configured to require manual force of between 1 Newton and 10 Newton as the continuous manual actuation.

In preferred embodiments, the manually operable controller and the pressure control unit are configured to exclusively switch between the default configuration and the second configuration. In other words, there are no intermediate configurations between the default and second configurations. Moreover, in some embodiments, the manually operable controller and the pressure control unit are configured to require both hands of a user to operate. For example, manually operable controller can be located at a distance from the pistol grip so that a user is required to hold the pistol grip with one hand and use the other hand to actuate the manually operable controller for semi-automatic operation. In another example, the same hand can be used to toggle between manual and semi-automatic operation whereby a non-trigger finger of one hand is used to provide continuous manual actuation while the trigger finger on the same hand fires the firearm.

In other aspects, a firearm that uses gas-operated reloading could comprise a single unit having a controller and pressure control valve. In such embodiment, the single unit could be mounted on the pistol grip or handguard depending on the comfort of the user. In addition, the single unit could also comprise a button or switch to transition from the first configuration to the second configuration.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A retrofit apparatus for a firearm having a gas-operated reloading unit that is configured to use a gas flow produced by firing a cartridge to reload the firearm, wherein the retrofit apparatus comprising:

a pressure control unit coupled to the reloading unit, wherein the pressure control unit has (i) a first configuration that reduces the gas flow to the reloading unit in an amount effective to prevent the reloading unit from reloading the firearm, and (ii) a second configuration that allows the gas flow to the reloading unit in an amount effective to enable the reloading unit to reload the firearm; and a controller operatively coupled to the pressure control unit and configured to operate the firearm in the first or second configuration, wherein the controller is configured to operate the firearm in the first configuration without continuous manual actuation, and operate the firearm in the second configuration with continuous manual actuation.

2. The retrofit apparatus of claim 1, wherein the pressure control unit comprises a ball valve that is sized and dimensioned to block the gas flow to the reloading unit in the first configuration, and to allow the gas flow to the reloading unit in the second configuration.

3. The retrofit apparatus of claim 1, wherein the pressure control unit comprises a chamber that is sized and dimensioned to receive a portion of the gas flow when the pressure control unit is in the first configuration.

4. The retrofit apparatus of claim 3, wherein the chamber is upstream of the reloading unit.

5. The retrofit apparatus of claim 3, wherein the chamber is further configured to send the portion of the gas flow to the reloading unit when the pressure control unit in the second configuration.

6. The retrofit apparatus of claim 3, further comprising a vent coupled to the chamber, wherein the vent is configured to release the portion of the gas flow to the atmosphere when the chamber reaches 90% capacity.

7. The retrofit apparatus of claim 3, further comprising a vent coupled to the chamber, wherein the vent is configured to release the portion of the gas flow to the atmosphere when the pressure control unit is in the first configuration.

8. The retrofit apparatus of claim 1, wherein the pressure control unit comprises blocking member, and wherein the blocking member is sized and dimensioned to block the gas flow to the reloading unit.

9. The retrofit apparatus of claim 1, further comprising a button operatively coupled to the controller, wherein the button is sized and dimensioned to receive continuous manual actuation.

10. The retrofit apparatus of claim 9, wherein the button is located on at least one of a barrel, a handguard, and a pistol grip of the firearm.

11. The retrofit apparatus of claim 9, wherein the button is sized and dimensioned to receive a force from a finger of a user as the continuous manual actuation.

12. The retrofit apparatus of claim 1, further comprising a touchpad operatively coupled to the controller, wherein the touchpad is sized and dimensioned to receive continuous manual actuation.

13. The retrofit apparatus of claim 12, wherein the touchpad is located on at least one of a barrel, a handguard, and a pistol grip of the firearm.

14. The retrofit apparatus of claim 12, wherein the touchpad is sized and dimensioned to receive a force from a finger of a user as the continuous manual actuation.

15. The retrofit apparatus of claim 1, wherein the controller is configured to operate the firearm only in the first configuration or the second configuration.

* * * * *